United States Patent [19]

Holk, Jr. et al.

[11] 4,012,935

[45] Mar. 22, 1977

[54] SCORE AND TOOL FOR FORMING THE SCORE

[75] Inventors: Albert J. Holk, Jr., Frankfort; Jerry D. Hawkins, Country Club Hills, both of Ill.

[73] Assignee: Continental Can Company, Inc., New York, N.Y.

[22] Filed: Apr. 11, 1975

[21] Appl. No.: 567,351

Related U.S. Application Data

[62] Division of Ser. No. 370,903, June 18, 1973, Pat. No. 3,898,944.

[52] U.S. Cl. ..... 72/325; 113/15 A

[51] Int. Cl.[2] ..... B21D 51/38

[58] Field of Search ..... 113/1 F, 121 C, 15 A; 220/266; 72/325; 83/6, 7

[56] References Cited

UNITED STATES PATENTS

| | | | |
|---|---|---|---|
| 3,765,352 | 10/1973 | Schubert et al. | 113/121 C |
| 3,900,128 | 8/1975 | Brown | 113/15 A |

*Primary Examiner*—Lowell A. Larson
*Attorney, Agent, or Firm*—Diller, Brown, Ramik & Wight

[57] ABSTRACT

A score having improved anti-fracture characteristics formed by a scoring punch including inclined sides merging at a flat bottom face. At least one of the sides is formed with a horizontal ledge parallel to the flat scoring face and located in vertical spaced relation from the face.

10 Claims, 3 Drawing Figures

SCORE AND TOOL FOR FORMING THE SCORE

This is a division of Ser. No. 370,903 filed June 18, 1973 now U.S. Pat. No. 3,898,944.

BACKGROUND AND SUMMARY OF THE INVENTION

The present invention relates to scoring of sheet metal to form a weakening line capable of being severed by a minimum force.

Weakening lines are used in containers for defining a removable panel section in the panel of the end closure. These weakening lines are generally formed by scoring in a manner such that the sheet metal is crushed to a predetermined thickness. The crushed thickness remaining is generally designated as the residual. In easy opening container structures it is essential that the residual is maintained at a minimum to facilitate the manual opening of the container. At the same time the residual must be sufficiently strong so as to resist fracture during normal handling so that the container remains tightly sealed until opening.

These conditions have been difficult to achieve and in particular when the end closure is made from a relative non-ductile material such as steel. Although it should be understood that care must also be taken to prevent inadvertent fracture when the material is aluminum.

The fracture during normal handling is believed to be caused by work hardening stresses or the like created during the scoring. Heretofore, it has been common practice to provide an additional score of lesser residual than the primary score. These lesser residual scores are known as anti-fracture scores and are not intended to provide a weakening line along which the end unit panel is to be severed. The anti-fracture scores have been concentrically located in radially spaced relation to the primary score line.

The radial spacing of the anti-fracture score from the primary score or weakening is not always convenient and frequently interferes with other structures which may be incorporated into the end unit.

By the present invention there is provided a primary score incorporating an anti-fracture means which is not located in radial spaced relation to the primary score. This is accomplished by a single score having a cross-section including a pair of inclined walls merging toward a scoring face which is spaced from one surface of the panel to provide a residual capable of being severed. At least one of the inclined walls has two offset sections connected by a land or ledge which is vertically spaced from the scoring face.

The above described score cross-section is accomplished by a scoring tool shaped generally complementary to the score.

BRIEF DESCRIPTION OF THE PREFERRED EMBODIMENT

Figure 1:
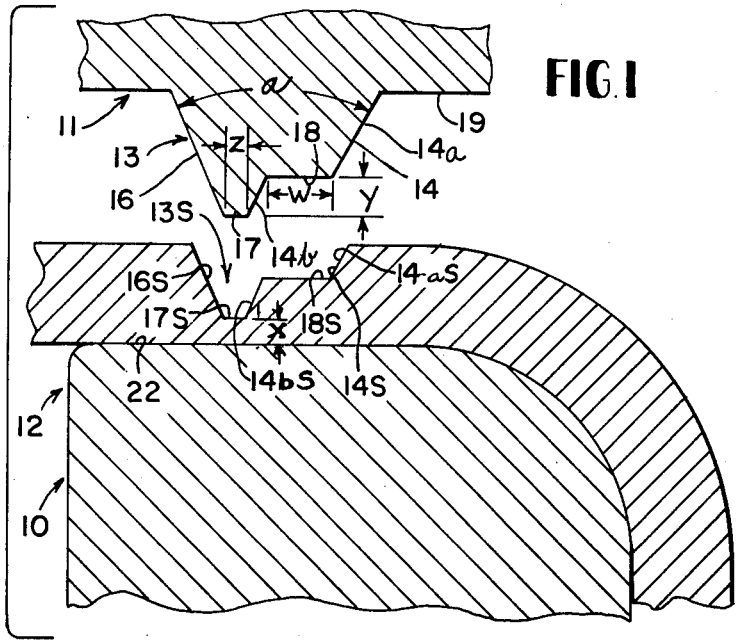
FIG. 1 is a greatly enlarged fragmentary cross-sectional view of the scoring tools and the score formed thereby.

As shown the scoring tool 10 of the present invention comprises a punch 11 and an anvil 12. The punch 11 includes a projecting rib 13 having equilateral inclined sides 14 and 16 which taper toward a horizontally disposed flat scoring face 17. The inclined side wall 14 includes a horizontal land or ledge 18 spaced intermediate the scoring face 17 and the base 19 of the rib 13. The land 18 divides the side wall into two offset and parallel side sections 14*a* and 14*b*.

The anvil 12 has a flat face 22 located opposite the punch 11 and is adapted to support the sheet metal which may be in the form of an end closure thereon. The punch 11 and anvil 12 are mounted in a press for movement toward and away from each between a closed and open position.

Upon movement to the closed position the rib 13 penetrates the surface of the sheet metal so as to score the sheet material by crushing and compressing the material to provide a residual which is of a thickness capable of being severed as by means of a pushing or pulling force applied by a tab or the like. The outline of the score 13S which is formed by the scoring tool 10 is generally complementary to the outline of the latter.

For convenience the walls defining the score 13S are designated by the same reference characters as those on the walls of the scoring rib 13 but with suffix S appended thereto. The score 13S includes converging sides 16S and 14S with side 14S including sections 14*a*S 14bS of which the latter are joined by a ledge 18S. The bottom of the score has a face 17S.

It is to be noted that the residual X is of a depth capable of being easily severed. Also the land 18S is spaced along the side 14S so that fracture does not occur along the line.

Figure 2:
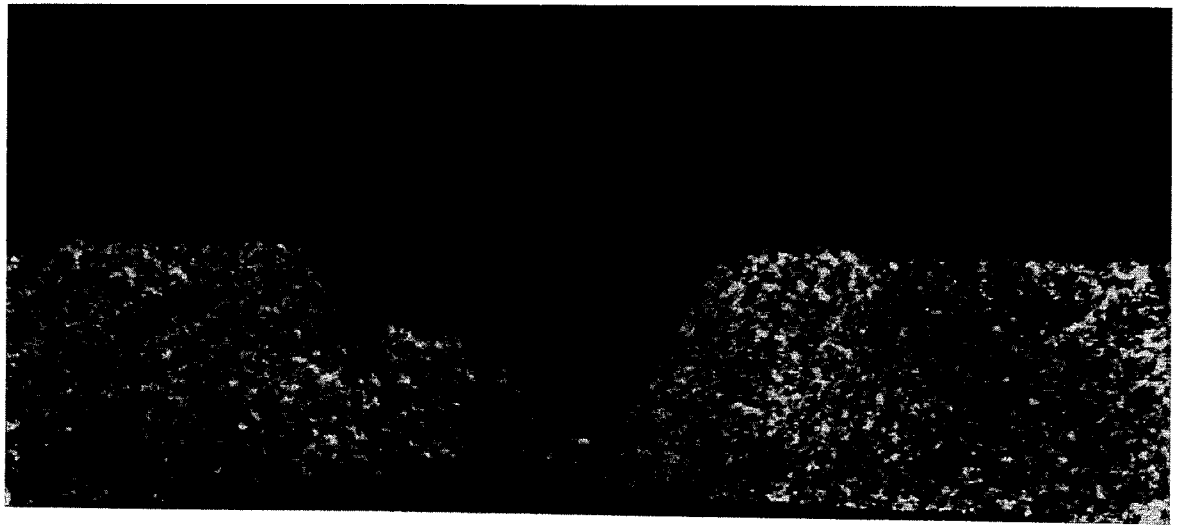
FIG. 2 is a greatly enlarged photomicrograph of the score formed with the tooling having the structure shown in FIG. 1.

FIG. 2 is a reproduction of a photomicrograph at 100X magnification through a sheet of metal having a score made by the tooling of the structure shown in FIG. 1. It is to be noted that the displacement of the metal is such that sharp walls and corners are not always formed as shown in FIG. 1. However, the terms "parallel" "flat" and "inclined" as used herein are intended to define the structure of the score shown in the photomicrograph of FIG. 2.

In the preferred form of the invention the included angle *a* between the sides 14 and 16 is between about 30° to 90° preferrably 50°. The distance *z* across the width of flat 17 is preferrably 0.002 inch and the distance *y* from the score face or flat 17 is about 0.003 inch. The width *w* of the land or ledge 18 is about 0.006 inch.

The scoring tool with the above dimensions was used to score a continuous cast steel sheet having a thickness of about 0.0095 inch. The steel sheet was scored with residuals of about 0.0018 inch without fracture.

This was an improvement over the scores obtained with a conventional score tool having an angle of 50° between the side walls. Such conventional score tools were used with the same type of sheet steel and excessive fracturing occurred with residuals of about 0.0028 inch. This is an increase of about 0.0010 inch in residual which may adversely affect the opening characteristics of the easy-opening container with which the score is intended to be used.

Figure 3:
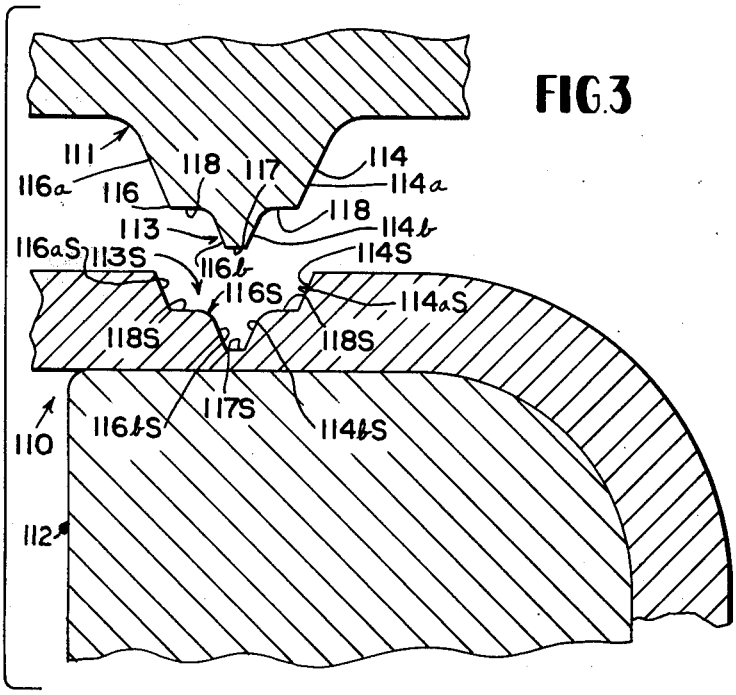
FIG. 3 is a greatly enlarged fragmentary cross-sectional view of another embodiment of the invention.

Referring now to FIG. 3 there is shown another embodiment of the invention. As shown the scoring tool 110 includes a punch 111 and an anvil 112. A scoring rib 113 projects from the punch 111. A pair of inclined side walls 114 and 116 which taper toward a flat scoring face 117 are each formed with a ledge or land 118. The lands 118 divided the respective side walls 114 and 116 into side wall sections 116*a*–116*b* and 114*a*–114*b* which are parallel to each other.

The punch 111 is forced into engagement 116bS the sheet metal disposed on the anvil 112 in the same manner as described in connection with the embodiment of FIG. 1. The rib 113 crushes the surface and forms a score 113S including a bottom flat 117S and wall sections 114aS and 114bS and 116aS and 116bS and ledges 118S. The ledges or lands 118S serve to displace additional material above the bottom face of the score during the scoring operation thereby apparently to relieve some of the stress associated with the scoring operation.

We claim:

1. A scoring punch for forming a score in a metal sheet, said scoring punch comprising a punch member having a base, a rib projecting from an intermediate portion of said base with said base having inoperative flat surfaces on opposite sides of said rib, said rib having a bottom wall, opposing side walls inclined directly from said base toward said bottom wall, and at least one of said side walls having a ledge intermediate the length thereof and spaced from said bottom wall and said base, said one side wall being in sloping relation to said base both above and below said ledge.

2. The invention as defined in claim 1 wherein said side walls form an included angle of about 50°.

3. The invention as defined in claim 2 wherein said bottom wall is a width of about 0.002 inch.

4. The invention as defined in claim 3 wherein said ledge is vertically spaced from said bottom wall a distance of about 0.003 inch.

5. The invention as defined in claim 4 wherein said ledge is a width of about 0.006 inch.

6. The invention as defined in claim 1 wherein a ledge is provided on each of said walls intermediate the lengths thereof and spaced from said bottom wall and said base.

7. The invention of claim 6 wherein the incline of each of said side walls is the same above and below the respective ledge.

8. The invention of claim 1 wherein said ledge is substantially parallel to said base and said bottom wall.

9. The invention of claim 1 wherein said ledge has a width approximately 3 times the width of said bottom wall.

10. The invention of claim 1 wherein the incline of said one side wall is same above and below said ledge.

* * * * *